US005934293A

United States Patent [19]

Kaizuka

[11] Patent Number: 5,934,293

[45] Date of Patent: Aug. 10, 1999

[54] HAIR IRON FOR STRAIGHT PERMANENT

[75] Inventor: Kazutoshi Kaizuka, Fukuoka, Japan

[73] Assignee: Create Co., Ltd., Japan

[21] Appl. No.: 09/215,044

[22] Filed: Dec. 17, 1998

[30] Foreign Application Priority Data

Jul. 23, 1998 [JP] Japan ..... 10-005492 U

[51] Int. Cl.[6] ..... A45D 2/40

[52] U.S. Cl. ..... 132/225; 132/224

[58] Field of Search ..... 132/118, 207, 132/223, 224, 225, 229, 232, 269, 271; 219/222, 225, 226, 230; 126/408, 409

[56] References Cited

U.S. PATENT DOCUMENTS

| | | | |
|---|---|---|---|
| 236,522 | 1/1881 | Wilson | 132/225 |
| 278,944 | 6/1883 | Hauce | 132/225 |
| 294,309 | 2/1884 | Campbell | 132/225 |
| 1,455,696 | 5/1923 | Wright | 132/225 |
| 2,155,282 | 4/1939 | Schoenling | 219/225 |
| 4,739,151 | 4/1988 | Smal | 219/225 |
| 4,917,078 | 4/1990 | Zaborowski | 126/409 |
| 5,357,988 | 10/1994 | Nakamura | 132/232 |
| 5,799,671 | 9/1998 | Takimae | 132/225 |

*Primary Examiner*—Gene Mancene
*Assistant Examiner*—Pedro Philogene
*Attorney, Agent, or Firm*—Graham & James LLP

[57] ABSTRACT

A hair iron for straight permanents includes a pair of arms joined by a pivot to enable opening and closing, and hair pinching parts formed in such a way that they approach and leave in accordance with the closing and opening of the arms. On both hair pinching parts, convex and concave arrays in waveform cross sections are formed in the arms so as to engage each other when the arms are in the approaching position. The convex and concave arrays are arranged in such a way that, along the full width of the hair pinching part, the hair tip region is dense with a short waveform pitch and the hair root region is sparse with a long waveform pitch.

1 Claim, 1 Drawing Sheet

HAIR IRON FOR STRAIGHT PERMANENT

BACKGROUND OF THE INVENTION

1. Field of the Invention

The present invention relates to hair irons for straight permanents, which hair irons are used in barber shops or beauty parlors to make curly hair straight.

2. Background Information

A conventional example of a hair iron for straight permanents is that described in the Japanese official gazette for Provisional Publication No. 189818/H6. That hair iron for straight permanents has a pair of arms joined by a pivot to enable opening and closing, with hair pinching parts being formed in such a way that they approach and leave in accordance with the opening and closing of the arms. An array of convex and concave patterns in a waveform cross section is formed in the extension of the arms so as to engage the complementary pattern in the opposing arm.

Thus, with that conventional hair iron, it is possible to make curly hair straight by holding the pair of arms, opening and closing them so as to pinch the hair, and then sliding them from the hair root to the hair tip, or moving them little by little from the hair root toward the hair tip while pressing the hair with the gripping pressure of the arms.

However, that conventional hair iron for straight permanents, with an array of convex and concave patterns having a waveform cross section in the hair pinching part, employs waveforms having a uniform pitch.

There are various types of hair, such as thick and coarse, and on the other hand, thin and soft. So, when creating a straight permanent, it is necessary to use a strong corrective force on thick and coarse hair, while it is important to use a light corrective force on thin and soft hair to prevent damage. Thus, it is necessary to apply a corrective force in accordance with the nature of the hair, taking into consideration the balance between the corrective force and probable hair damage. Whereas, with previous designs, waveforms were made with the same pitch, requiring the same corrective force. As a result, in order to apply a corrective force in accordance with the nature of a particular type of hair, it has been necessary to prepare several hair irons for straight permanents with different waveform pitches.

Also, when only one type of hair iron is used for straight permanents, it is necessary to use fine techniques such as adjusting the movement of the hair iron in accordance with the nature of the hair, or adjusting the gripping pressure of the hair pinching parts. This leads to a problem in that a satisfactory permanent can be carried out only by skilled hairdressers.

The present invention is aimed at overcoming the above-mentioned problems. Thus, an object of the present invention is to provide a hair iron for straight permanents which can be satisfactorily used not only by skilled hairdressers, but also by those with less experience. The invention also makes it possible to carry out a straight permanent by applying a corrective force in accordance with the nature of the hair, taking into consideration the balance between the corrective force and probable hair damage with the use of only one hair iron.

SUMMARY OF THE INVENTION

In order to overcome the above-mentioned problems, a hair iron for straight permanents has been developed.

At the tips of a pair of arms, which are joined by a pivot so as to enable opening and closing, hair pinching parts are formed in such a way that they approach and leave in accordance with the opening and closing of said arms.

On both hair pinching parts, convex and concave arrays in a waveform cross section are formed in the extension of said arms so as to engage other when said arms are in the approaching position.

The array of convex and concave patterns are arranged in such a way that, in the full width of the hair pinching part, the region of the hair tip side is dense with a short waveform pitch and the region of the hair root side is sparse with a long waveform pitch.

The hair pinching parts are comprised of dense convex and concave arrays with a short waveform pitch in the hair tip region and sparse arrays with a long waveform pitch in the hair root region. The dense area, with a short waveform pitch, has accordingly more arrays so that a strong corrective force is facilitated. On the other hand, the sparse area, with a long waveform pitch, has accordingly less arrays, and provides a light corrective force. That is, the dense area with a strong corrective force is designed to act on thick and coarse hair, while the sparse area with light corrective force is designed to act on thin and soft hair.

With the hair iron for straight permanent, comprised of dense and sparse areas, it is possible to carry out a desired treatment using only one hair iron with respect to both types of hair, that is, thick, coarse hair, and thin, soft hair. This makes it unnecessary to use different hair irons for different types of hair. Therefore, it is not necessary to prepare several hair irons for a straight permanent with different waveform pitches, thus reducing the number of instruments needed for getting a straight permanent.

BRIEF DESCRIPTION OF THE DRAWINGS

With reference to the accompanying figures, a preferred embodiment of the present invention will be explained more in detail.

DETAILED DESCRIPTION OF THE PREFERRED EMBODIMENT

Figure 1:
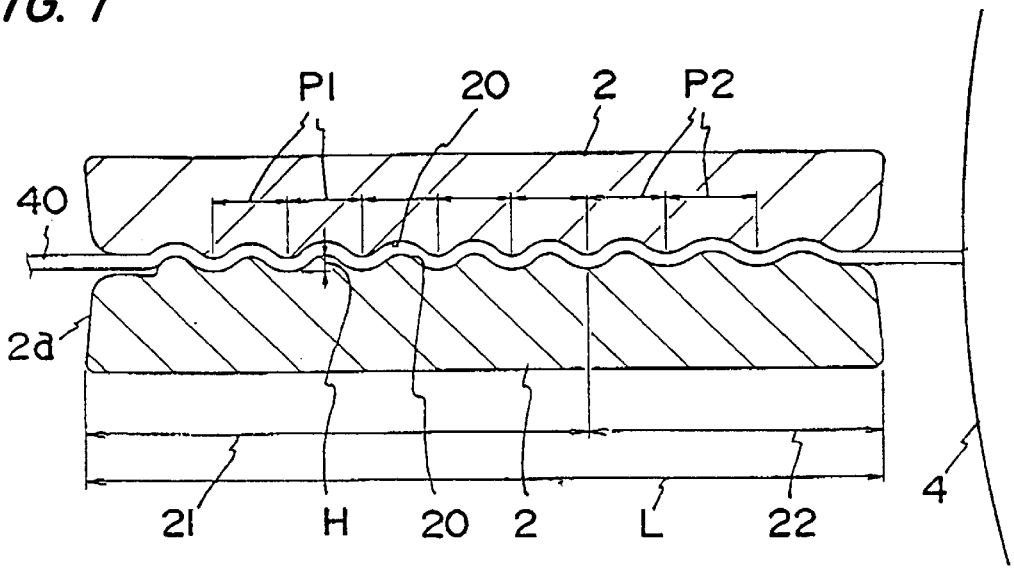
FIG. 1 is a sectional view showing a hair pinching part of the preferred embodiment of the present hair iron for straight permanents invention.
Figure 2:
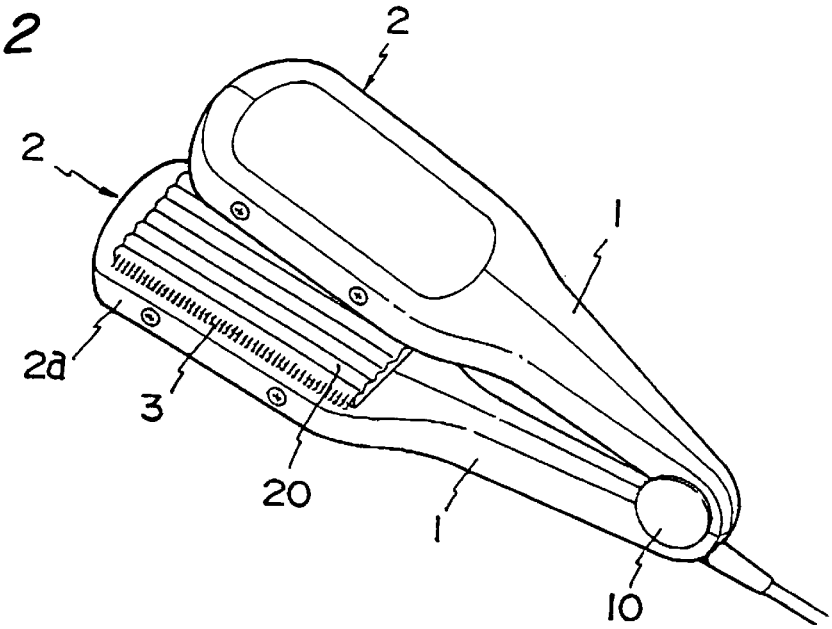
FIG. 2 is a perspective view of the hair iron for straight permanents.

With reference to the accompanying drawings, the preferred embodiment of the present invention will be explained more in detail. FIG. 1 is a cross-sectional view showing the hair pinching part of the newly invented hair iron for straight permanents. FIG. 2 shows, in perspective, an entire view of the hair iron for straight permanents.

The preferred embodiment of the hair iron for straight permanents is comprised of a pair of arms 1, 1 which are joined by means of a pivot 10 so as to enable opening and closing of the arms 1, 1. At the tips of both arms 1, 1, are hair pinching parts 2, 2 which approach and leave according to the opening and closing of said arms 1, 1. Here, a heater (not shown) is incorporated in the hair pinching parts 2, 2. In addition, on the end of one arm 1, are teeth of a comb 3 along the hair tip side edge 2*a*.

On the surfaces of both hair pinching parts 2, 2 facing each other, are convex and concave arrays in a cross section of waveform 20, 20 in the extension of the arms 1, 1 which engage each other in the approaching position. These convex and concave arrays are arranged, as shown in FIG. 1, in such way that, in the full width L of the hair pinching part 2, the hair tip region 21 is dense with a short waveform pitch P1. The hair root region 22 is sparse with a long waveform pitch P2. More specifically, the region from the hair tip side edge 2*a* to about two-thirds of the full width of the hair pinching part 2 forms a dense area at the hair tip region 21 with a short waveform pitch P1. The remaining one-third forms a sparse area at the hair root region 22 with a long waveform P2. In the preferred embodiment, the full width of the hair pinching part 2 is 36 mm. The dense area at the hair tip region 21 is comprised of seven convex and concave arrays 20 with a waveform pitch P1 of 3 mm; the sparse area at the hair root region 22 is comprised of two convex and concave arrays 20 with a waveform pitch P2 of 4.5 mm; the wave height of each convex and concave array being 0.5 mm. In FIG. 1, 4 represents a scalp and 40 represents hair.

When using this hair iron for straight permanents, using normal permanent agents, hair 40 can be straightened by performing the following steps: hold the pair of arms 1, 1 and pinch the hair 40 with the hair pinching parts 2, 2 with the opening and closing action of the arms 1, 1; then slide the hair pinching parts 2, 2 from the hair root side to the hair tip side, or move them little by little from the hair root side to the hair tip side so as to apply a gripping pressure to the hair 40.

In the preferred embodiment, the concave and convex arrays 20, 20 of the hair pinching parts 2, 2 comprised of the dense area at the hair tip region 21 and the sparse area at the hair root region 22 transmit pressure. The dense area at the hair tip region 21 with a short waveform pitch P1 has accordingly more arrays 20, so that a strong corrective force can be applied. On the other hand, the sparse area at the hair root region 22 with a long waveform pitch P2 has fewer arrays 20, so that a light corrective force can be applied. That is, the dense area at the hair tip region 21 with a strong corrective force acts on thick and coarse hair; and the sparse area at the hair root region 22 with a light corrective force acts on thin and soft hair.

Since the hair iron is equipped with both dense areas at the hair tip region 21 and sparse areas at the hair root region 22, it is possible to treat both types of hair—that is, thick, coarse hair and thin, soft hair—without using different hair irons according to the type of hair. Therefore, it is not necessary to prepare several hair irons for a straight permanent with different waveform pitches, thus reducing the number of instruments needed for getting a permanent.

The present invention has been explained with reference to the drawings. Specific constructions are not limited to the descriptions above. Actually, it is possible to make appropriate determinations for each case, such as, the proportion of dense and sparse areas with respect to the full width of the hair pinching part, the number and pitch of concave and convex waveform arrays, the height of wave, and the like.

As a result, the hair iron can be used, not only by skilled hairdressers, but also by those who are less experienced, making it possible to carry out straight permanents by applying a corrective force according to hair type, taking into consideration the balance between the corrective force and the possible damage to hair.

I claim:

1. A hair iron for straight permanents comprising:

a pair of arms which are joined by a pivot so as to enable opening and closing motions;

a pair of hair pinching parts, with one hair pinching part attached to each of said arms, said hair pinching parts being formed in such a way that they approach and leave in accordance with the closing and opening motion of said arms;

said hair pinching parts being formed to define convex and concave arrays in the extension of said arms so that each hair pinching part may engage the other when said arms approach each other; and said convex and concave arrays having a hair tip region and a hair root region, said convex and concave arrays being arranged in such a way that the hair tip region is denser with a relatively shorter waveform pitch and the hair root region is sparser with a relatively longer waveform pitch.

* * * * *